US005088668A

United States Patent [19]

Grimm

[11] Patent Number: 5,088,668

[45] Date of Patent: Feb. 18, 1992

[54] WRIST REST

[75] Inventor: Thomas M. Grimm, Robbinsdale, Minn.

[73] Assignee: Ergodyne Corporation, St. Paul, Minn.

[21] Appl. No.: 692,190

[22] Filed: Apr. 26, 1991

[51] Int. Cl.[5] ..... B43L 15/00

[52] U.S. Cl. ..... 248/118.3; 400/715

[58] Field of Search ..... 248/118, 118.1, 118.3, 248/118.5, 918; 400/715, 492

[56] References Cited

U.S. PATENT DOCUMENTS 4,481,556 11/1984 Berke et al. ..... 248/118 X
4,545,554 10/1985 Latino et al. ..... 248/118.3 X
4,997,054 3/1991 Denny et al. ..... 248/118 X

*Primary Examiner*—Ramon O. Ramirez

*Attorney, Agent, or Firm*—Merchant, Gould, Smith, Edell, Welter & Schmidt

[57] ABSTRACT

A wrist rest (10), being positioned on a generally planar surface, includes a generally cylindrical sector support member (15) having an outside surface and an inside surface. A generally cylindrical sector base member (11) has an outside surface and an inner surface, the inside surface of the support member positioned proximate the outside surface of the base member (11). The members (11) and (15) are substantially concentric. The members (11) and (15) may be locked in a plurality of relative positions after relative rotational movement between the members (11) and (15), thereby defining a plurality of radial heights of the wrist rest (10) with respect to the planar surface. The support member (15) may include a first section (16) and second section (17) and further the distance between the sections (16) and (17) is adjustable.

15 Claims, 4 Drawing Sheets

WRIST REST

BACKGROUND OF THE INVENTION

1. Field of the Invention

This invention relates generally to wrist rests, and more particularly to a wrist rest which incorporates an adjustment to easily vary the height of the wrist rest and may also include an adjustment to vary the overall length of the wrist rest.

2. Description of the Prior Art

Wrist rests are well known in the art. Wrist rests are utilized for a variety of purposes, one of the most common being when the user is operating a keyboard. When a person is operating a keyboard, positioning of wrists in an unsupported manner for a long period of time may lead to injuries such as carpal tunnel syndrome. The wrist rest maintains the wrist is a neutral position to reduce the likelihood of developing carpal tunnel syndrome. To most effectively reduce carpal tunnel syndrome or related injuries, it is very advantageous to have the wrist rest at the proper height and also utilize a wrist rest which is of an appropriate length.

One of the most common wrist rests available is a rectangular pad. However, one of the disadvantages with a rectangular pad is that there is no height adjustment. Accordingly, pads with different heights must be used for different applications or users. Some prior art devices are available which do allow for height adjustment. However, the adjustment is usually by means of some mechanical adjustment such as rotation of screws or the like. Alternately, height adjustment spacers may be placed between the generally planar work surface and the wrist rest to adjust the height. Still further, Applicant is aware of no wrist rest which is adjustable in length. Typical keyboards are from 16 inches to 22 inches in width. Therefore, it would be advantageous to have a wrist rest which could be adjusted in length depending upon the width of the keyboard.

The present invention addresses the problems associated with the prior art and provides for a wrist rest which is easily adjustable in its height and also its length.

SUMMARY OF THE INVENTION

The present invention is a wrist support for supporting a user's wrist. The wrist rest is generally positioned on a planar surface. The rest includes a generally cylindrical sector support member having an outer surface and an inner surface. Further, there is a generally cylindrical sector base member having an outside surface and an inside surface. The inside surface of the support member is positioned proximate the outside surface of the base member. The members are substantially concentric. Means are provided for locking the members in a plurality of relative positions after relative rotational movement between the members, thereby defining a plurality of radial heights of the wrist rest with respect to the planar surface. In a preferred embodiment, the cylindrical sector support member has a right section and a left section and further comprises means for adjusting a distance between the right sections and left sections.

In one embodiment, the locking means comprises a plurality of space, longitudinal openings formed in one of the inside and outside surfaces, and a longitudinal protrusion operatively connected to the other of said inside and outside surfaces, the protrusion slideable in a longitudinal direction, but lock said members from further relative rotational movement. In another embodiment, the locking means comprises a plurality of spaced indentations formed in one of the inside and outside surface, and a plurality of spaced protrusions operatively connected to the other of the inside and outside surfaces, the protrusions forming a friction fit with the indentations. The spacing indentations are at a spacing generally equal to a spacing of the spaced protrusions.

DETAILED DESCRIPTION OF THE PREFERRED EMBODIMENT

Figure 1:
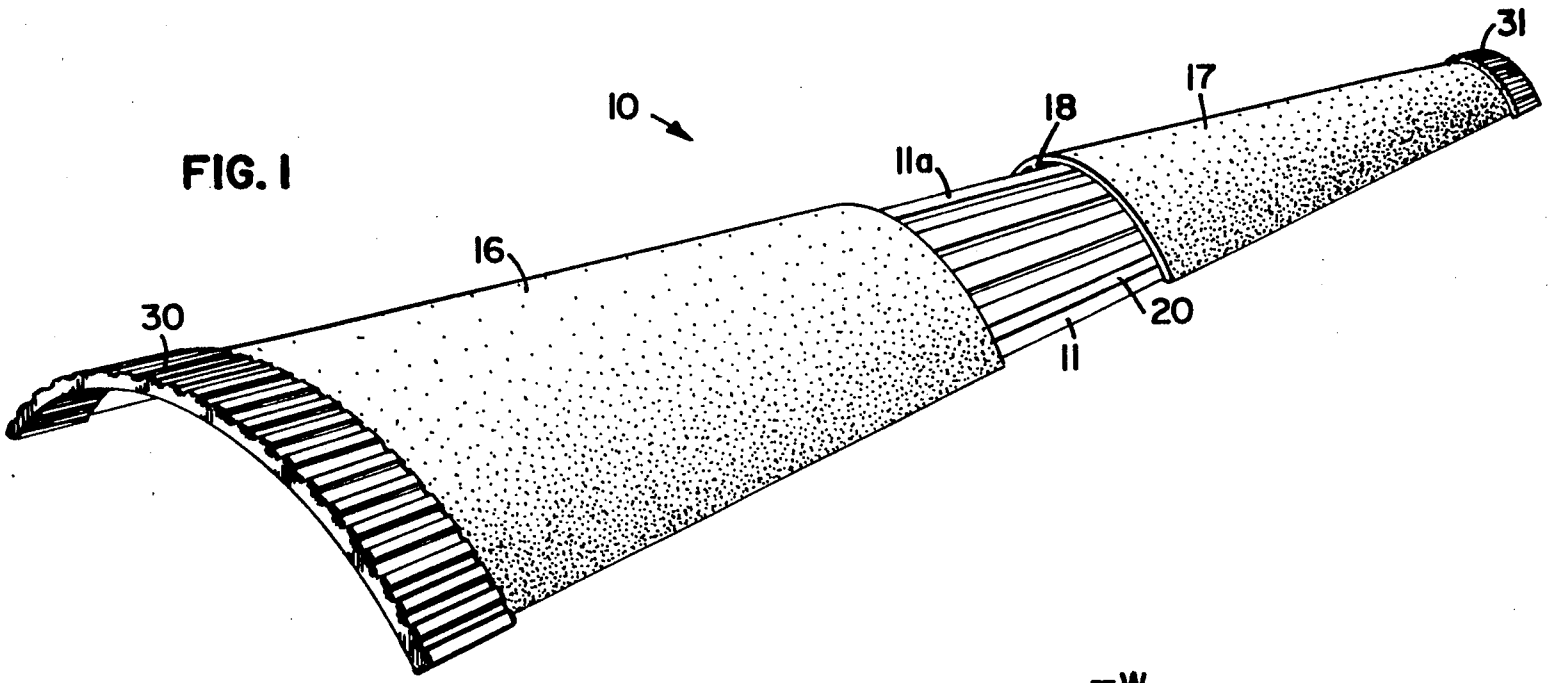
FIG. 1 is a perspective view of the wrist rest incorporating my present invention.
Figure 4:
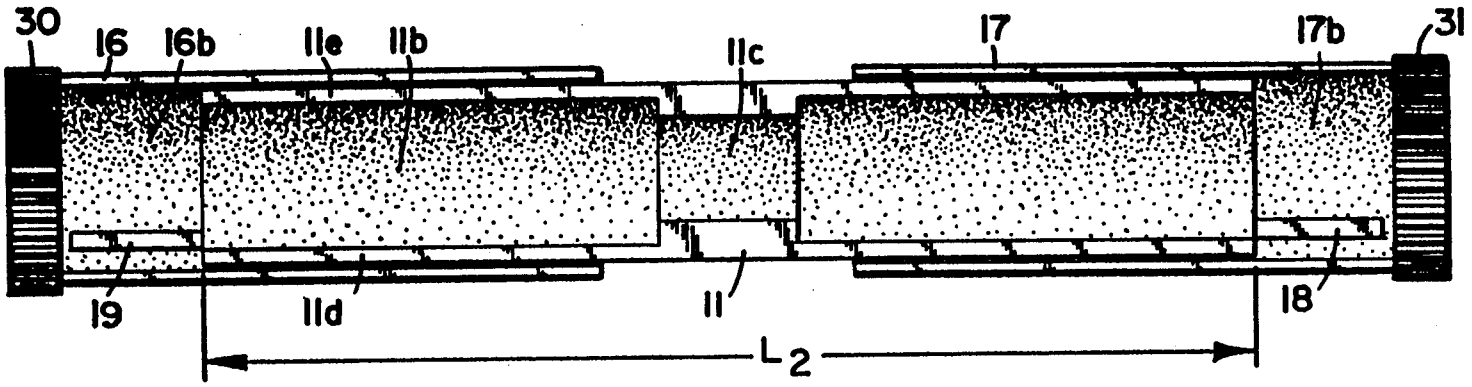
FIG. 4 is a bottom plan view of the wrist rest shown in FIG. 1.
Figure 5:
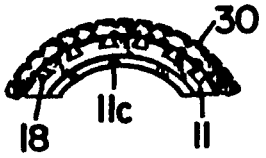
FIG. 5 is a right side elevational view of the wrist rest shown in FIG. 1, the left side elevational view being a mirror image thereof.
Figure 6:
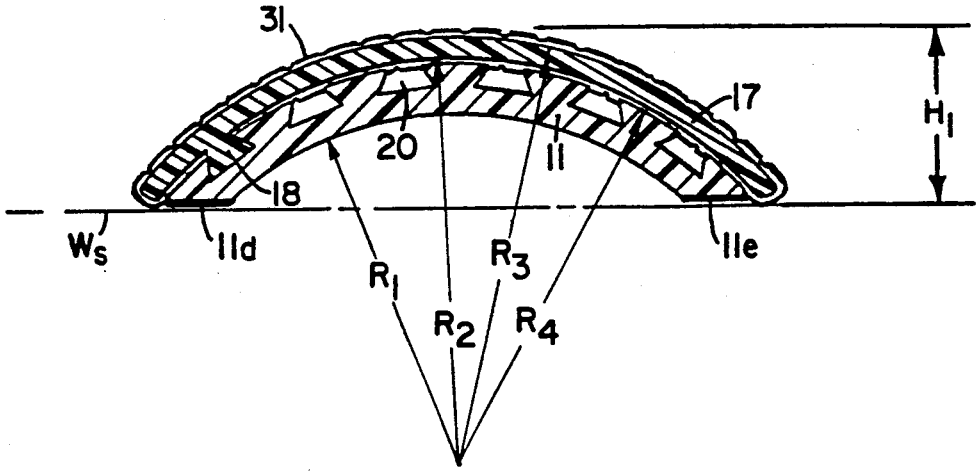
FIG. 6 is a cross-sectional view taken generally along the lines 6—6 of the wrist rest of FIG. 1.

Referring to the drawings, wherein like numerals represent like parts throughout the several views, there is generally disclosed at 10 a wrist rest. The wrist rest 10 includes a base member 11 having an outside surface 11*a* and inner surface 11*b*. The outside surface 11*a* is generally arcuate in shape and further, the entire base member 11 has the general shape of a cylindrical sector. As will be described more fully hereafter, the base member 11 provides for an adjusting rail for the overall length of the wrist rest 10. The inner surface 11*b* is also arcuate and is generally concentric with the outside surface 11*b*. As can be seen in FIG. 4, a rectangular gripping member is operatively connected to the inner surface 11*b* and preferably an integral part thereof. The function of the gripping member is to allow for easier adjustment of the length of the rest, as will be described more fully hereafter. A plurality of generally parallel dovetail mortises or grooves 20 are formed in the outside surface 11*a* of the base member 11. The general configuration of the dovetail mortises 20 are best seen in FIGS. 1 and 6. Referring now to FIGS. 4 and 6, it can be seen that the inner surface 11*b* is generally arcuate. However, along the length of the base member 11 is a first generally planar surface 11*d* and a second generally planar surface 11*e*. The planar surfaces 11*d* and 11*e* are generally also in the same plane. As will be described more fully hereafter, the planar surfaces 11*d* and 11*e* provide a resting surface for the wrist rest 11 on a working surface.

The wrist rest 10 also includes a support member, generally designated as 15. The support member 15 includes a first section 16 and a second section 17. The second section 17 has an outer surface 17*a* and an inside surface 17*b*. The second section 17 is generally in the shape of a cylindrical sector. The outer surface 17*a* is generally arcuate and forms a rest for one wrist. The inside surface 17*b* is generally arcuate and is also generally concentric with the outside surface 11*a* of the base member 11. The inside surface 17*b* is also generally concentric with the outside surface 11*a*. A dovetail tenon 18 is operatively connected to the second section 17, and is preferably as an integral portion thereof. The dovetail tenon is sized and configured to slide in the dovetail mortise 20. Referring now to FIG. 6, it can be seen that the height of the dovetail tenon 18 is slightly larger than the height of the dovetail mortise 20. Accordingly, there is a slight clearance between the outside surface 11*a* of the base member 11 and the inside surface 17*b* of the second section 17.

The first section 16 has an outer surface 16*a* and an inside surface 16*b*. The first section 16 is generally in the shape of a cylindrical sector. The outer surface 16*a* is generally arcuate and forms a rest for the other wrist. The inside surface 16*b* is generally arcuate and is also generally concentric with the outside surface 11*a* of the base member 11. The inside surface 16*b* is also generally concentric with the outside surface 11*a*. A dovetail tenon 19 is operatively connected to the first section 16, and is preferably as an integral portion thereof. The dovetail tenon is sized and configured to slide in the dovetail mortise 20. The height of the dovetail tenon 19 is also slightly larger than the height of the dovetail mortise 20. Accordingly, there is a slight clearance between the outside surface 11*a* of the base member 11 and the inside surface 16*b* of the first section 16.

End caps 30 and 31 are operatively connected to the sections 16 and 17 respectively. The end caps 30 and 31 are arcuate in shape and match the general arcuate shape of the sections 16 and 17. The end caps 30 and 31 have a cavity which is sized approximate the same size as the end of the sections 16 and 17 so that the end of the sections may be pushed into the respective cavities in the end caps 30 and 31. The cavities are sized such that there is a slight force that is needed to insert the ends into the cavities. Therefore, the end caps will stay in place when positioned on the sections 16 and 17. The end caps may be constructed of any suitable material, such as a thermoplastic rubber, such as Sanoprene® as sold by Monsanto. The end caps provide a surface which help prevent sliding of the wrist rest when on the support surface. In addition, the end caps will assist in preventing static electricity from being transmitted.

The base member 11, support member 15 and dovetail tenons 18 and 19 may be made of any suitable material, but Applicant has found that plastic, such as rigid polyvinyl chloride, is one suitable material. Further, the components are formed by extrusion, however, other suitable means of manufacture may also be utilized.

Figure 9:
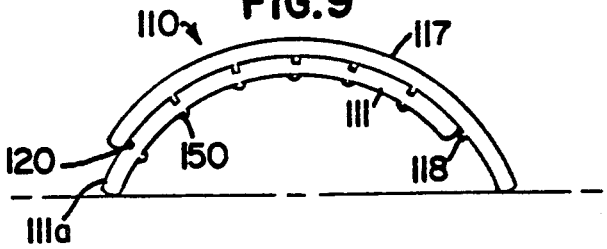
FIG. 9 is a side-elevational view of an alternative embodiment of the present invention.

A second embodiment of the present invention is shown in FIG. 9. The second embodiment is similar to the first embodiment with the difference being the use of a different locking means between the base member and support member. Accordingly, only the different locking means will be discussed in detail, it being understood that the remainder of the embodiment is similar to the first embodiment. The locking means includes a plurality of protrusions 118 operatively connected to the inside surface of the support member 115. These protrusions 118 are operatively connected to both the first section and second section 117. The second section 117 is shown in FIG. 9, it being understood that the first section would be similarly constructed. The protrusions 118 are generally rectangular in shape and are elongate and also generally parallel to each other. In a preferred embodiment, the protrusions are extruded along with the section and are an integral portion thereof. The protrusions 118 are spaced at an equal distance. The base member 111 has a plurality of openings 120 which are formed in the outside surface 11*a* of the base member 11. The openings 120 are generally parallel to each other and spaced at intervals which coincide to the spacing of the protrusions 118. The openings 120 extend substantially the entire length of the base member 111. The protrusions 118 are sized to have a slight snap fit with respect to the openings 120 such that the protrusions 118 will be firmly held in the openings 120, but still are capable of being snapped out of their locked position by the application of an upward force.

Figure 2:
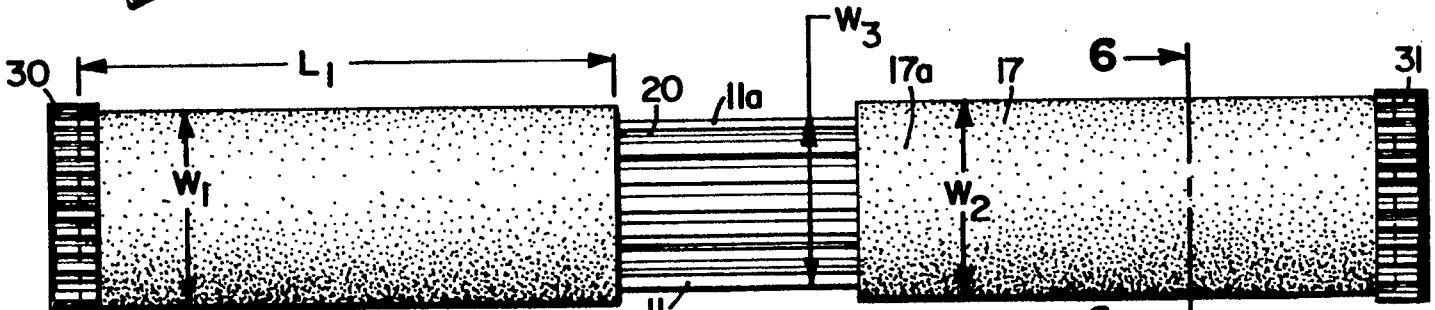
FIG. 2 is a top plan view of the wrist rest shown in FIG. 1.
Figure 3:
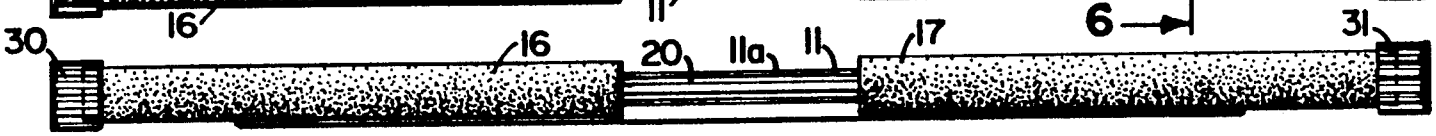
FIG. 3 is a front elevational view of the wrist rest shown in FIG. 1, the rear elevational view being a mirror image thereof.
Figure 7:
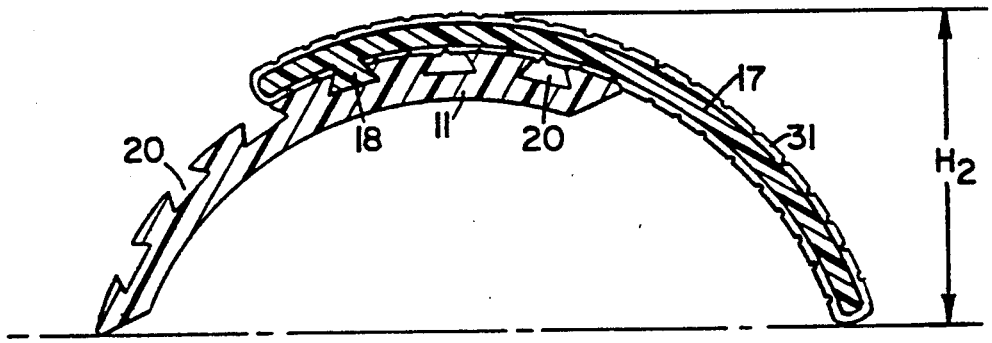
FIG. 7 is a cross-sectional view of wrist rest of FIG. 1 after the base member has been rotated relative to the support member.
Figure 8:
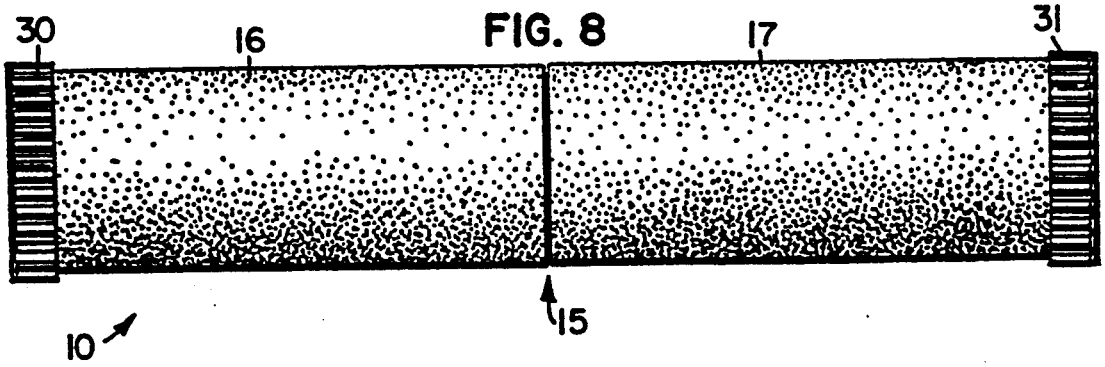
FIG. 8 is a top plan view of the wrist rest shown in FIG. 2, shown adjusted to a different length.

In use, the support member 15 is locked into one of a plurality of positions on the base member 11 in order to provide one of a plurality of radial heights above a generally planar work surface Ws. In addition, the first section 16 and second section 17 of the support member 15 are adjusted so as to provide the proper distance between the sections. Referring to FIGS. 6 and 7, it can be seen how the wrist rest 10 may be adjusted to a variety of heights. The work surface is represented by the horizontal dashed line Ws. FIG. 1 shows a first radial height H and FIG. 7 shows a second radial height $H_2$. By rotating the sections 16 and 17 relative to each other and then locking the sections in position by insertion of the tenons 18 and 19 into the mortise 20 different radial heights are possible. The radial height is dependent in which mortise 20 the tenons 18 and 19 are inserted. Referring to FIGS. 2 and 8, it can be seen how the overall length of the wrist rest 10 may be adjusted by simply sliding the sections 16 and 17 outward or away from each other. FIG. 8 shows the sections 16 and 17 when they are next to each other and FIG. 2 shows the sections after they have been separated. While it is understood that other suitable dimensions may be used, one example of the present invention has the length $L_1$ of sections 16 and 17 to be eight inches. The length $L_2$ of the base 11 is 15 inches. To separate the sections, one simply grasps the section 16 and base member 11 with one hand with the other hand you simply slide the section 17 outward. The gripping member 11*c* may be utilized to have one obtain a better grasp on the base member 11. Similarly, the first section 16 may be slid away from the center of the rest 10. With the sections 16 and 17 extended to the farthest distance, the overall length of the wrist rest 10 would be approximately 30 inches. The length can be easily varied between 16 inches to 30 inches. Also, the first embodiment is easily adjustable between a radial height of approximately ¾ inch up to approximate 1½ inches. The width of the base member 11 is approximately 2½ inches. The height of the dovetail tenon is approximately 5/32 inch. The groove of the dovetail mortise is approximately ⅛ inch. The difference between the height of the dovetail tenon and the depth of the mortise allows for a clearance to be formed between the base 11 and support member 15. Referring to FIG. 6, it can be seen that the outside surface 11*a* of the base member 11 and the inside surface 17*b* of the second section are generally concentric. This allows for the relative rotational movement between the base member 11 and support member 15. Further, the outer surfaces 16*a* and 17*a* are concentric with the outside surface 11*a*. While the outer surface 16*a* and 17*a* are generally circular, other suitable configurations may be utilized to provide for proper support. However, the use of a circular outer surface provides for the same resting surface independent upon the relative rotational movement of the base member 11 to support member 15. Still further, the inside surfaces 16*b* and 17*b* are also concentric with the outside surface 11*a*, however other suitable configurations may be utilized. Referring to FIG. 6, it can be seen that each of the surfaces has a radius from a common center. In one embodiment, the dimensions are as follows: $R_1=1.67$ inches, $R_2=1.87$ inches, $R_3=2.00$ inches, $R_4=1.86$ inches.

The user adjusts the specific height of the wrist rest 10 that is comfortable and then appropriately rotates the base member 11 with respect to the support member 15 to achieve the proper radial height. Then, the dovetail tenons are inserted in the appropriate mortise and the support member 15 is no longer able to be rotated relative to the base member 11. This locks in the specific radial height that is desired. Then, the user simply adjusts the width of the wrist support 10 by moving the sections 16 and 17 either closer together or farther apart.

When using the second embodiment, the wrist rest 110 is snapped together by having the protrusions snapped into place into the appropriate openings 120. The base member is rotated relative to the support to obtain the necessary radial height and then the protrusions 118 are snapped into place in the corresponding grooves 120. The spacing of the grooves 120 is substantially identical to the spacing of the protrusions 118 so as to allow for alignment at the various relative rotational positions between the base member and support member. Because there is a friction fit between the protrusions 118 and 120, it is necessary for the user to first determine the desired overall width of the wrist rest 10 so as to have the support member snapped in at the appropriate position along the length of the base member. The overall length of the rest 110 is still easily adjustable by simply removing the sections and locking them in position at a different location, longitudinally, along the base member.

Figure 10:
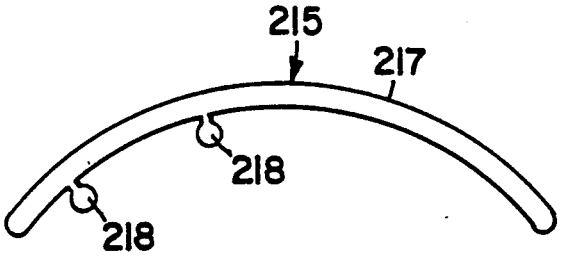
FIG. 10 is a side elevational view of a section of the support member of a third embodiment of the present invention.
Figure 11:
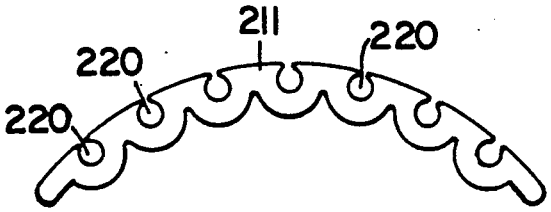
FIG. 11 is a side elevational view of a base member for use with the support member shown in FIG. 10.

A third embodiment of the present invention is shown in FIGS. 10 and 11. The third embodiment is similar to the first embodiment, with the difference being the use of a different locking means between the base member and support member. Accordingly, only the locking means will be discussed in detail, it being understood that the remainder of the embodiment is similar to the first embodiment. The locking means includes two protrusions 218 operatively connected to the inside surface of the support member 215. These protrusions 218 are operatively connected to both the first section and second section 217. The second section 217 is shown in FIG. 10, it being understood that the first section would be similarly constructed. The protrusions 218 are generally circular in shape and are elongate and are also generally parallel to each other. In a preferred embodiment, the protrusions are extruded with a section and are an integral portion thereof. The protrusions 218 are spaced at a given distance. The base member 211 has a plurality of openings 220 which are generally parallel to each other and spaced at intervals which are equal to the spacing between the protrusions 218. The openings 220 extend substantially the entire length of the base member 211. The protrusions 218 are sized to slide within the openings 220, very similar to the way the dovetail tenons 18 and 19 slide within the dovetail mortises 20. In is understood that other matching configurations between the protrusions and openings are contemplated within the scope of the present invention.

It is recognized that changes may be made to the described embodiments and still come within the scope of the invention. For instance, in the first embodiment, while there are shown a plurality of openings and only one protrusion, it is of course possible that there would be a plurality of protrusions and only one opening or a plurality of protrusions and plurality of openings. Similarly, with respect to the second embodiment, there may not be a plurality of both protrusions and openings. There could also be a single protrusion with a plurality of openings or a single opening with a plurality of protrusions.

Other modifications of the invention will be apparent to those skilled in the art in light of the foregoing description. This description is intended to provide specific examples of individual embodiments which clearly disclose the present invention. Accordingly, the invention is not limited to these embodiments or the use of elements having specific configurations and shapes as presented herein. All alternative modifications and variations of the present invention which follow in the spirit and broad scope of the appended claims are included.

I claim:

1. A wrist rest for supporting a user's wrist, said wrist rest being positioned on a generally planar surface, said rest comprising:

(a) a generally cylindrical sector support member having an outer surface and an inside surface;

(b) a generally cylindrical sector base member having an outside surface and an inner surface, said inside surface of said support member positioned proximate said outside surface of said base member, said members substantially concentric; and (c) means for locking said members in a plurality of relative positions after relative rotational movement between said members, thereby defining a plurality of radial heights of said wrist rest with respect to the planar surface.

2. The wrist rest of claim 1, wherein said locking means comprises a plurality of spaced, longitudinal openings formed in one of said inside and outside surfaces, and a longitudinal protrusion operatively connected to the other of said inside and outside surfaces, said protrusion slideable in a longitudinal direction but lock said members from further relative rotational movement.

3. The wrist rest of claim 1, wherein said locking means comprises a plurality of spaced indentations formed in one of said inside and outside surfaces, and a plurality of spaced protrusions operatively connected to the other of said inside and outside surfaces, said protrusions forming a friction fit with said indentations, said spaced indentations at a spacing generally equal to a spacing of said spaced protrusions.

4. The wrist rest of claim 1, further comprising said cylindrical sector support member having a right section and a left section.

5. The wrist rest of claim 2, further comprising means to adjust a distance between said right sections and said left sections.

6. The wrist rest of claim 5, wherein said adjustment means comprises said right section and left section being slideable in said openings, thereby adjusting the distance between said sections.

7. A wrist rest for supporting a user's wrist, said wrist rest being positioned on a generally planar surface, said rest comprising:

(a) a generally cylindrical sector support member having an outer surface and an inside surface, said member having a right section and a left section;

(b) a generally cylindrical sector base member having an outside surface and an inner surface, said inside surface of said support member positioned proximate said outside surface of said base member, said members substantially concentric;

(c) means for adjusting a distance between said right and left sections; and (d) means for locking said members in a plurality of relative positions after relative rotational movement between said members, thereby defining a plurality of radial heights of said wrist rest with respect to the planar surface, said locking means comprises a plurality of spaced, longitudinal openings formed in one of said inside and outside surfaces, and a longitudinal protrusion operatively connected to the other of said inside and outside surfaces, said protrusion slideable in a longitudinal direction but lock said members from further relative rotational movement.

8. A wrist rest for supporting a user's wrist while performing an activity, comprising:

(a) a first member having an outer surface, an arcuate inside surface;

(b) a second member having an inner surface, an arcuate outside surface;

(c) said arcuate inside surface positioned on top of said arcuate outside surface and configured to be rotated relative to each other; and (d) means for locking said surfaces in one of a plurality of positions, whereby said rest may have a plurality of heights.

9. The wrist rest of claim 8, wherein said locking means comprises a plurality of spaced, longitudinal openings formed in one of said inside and outside surfaces, and a longitudinal protrusion operatively connected to the other of said inside and outside surfaces, said protrusion slideable in a longitudinal direction but lock said members from further relative rotational movement.

10. The wrist rest of claim 8, wherein said locking means comprises a plurality of spaced indentations formed in one of said inside and outside surfaces, and a plurality of spaced protrusions operatively connected to the other of said inside and outside surfaces, said protrusions forming a friction fit with said indentations, said spaced indentations at a spacing generally equal to a spacing of said spaced protrusions.

11. The wrist rest of claim 8, further comprising said first member having a right section and a left section.

12. The wrist rest of claim 11 further comprising means to adjust a distance between said right section and said left section.

13. The wrist rest of claim 12, wherein said adjustment means comprises said right section and left section being slideable in said openings, thereby adjusting the distance between said sections.

14. The wrist rest of claim 8, further comprising arcuate end caps operatively connected at each end of said first member.

15. A wrist rest for supporting a user's wrist while performing an activity, comprising:

(a) a first member having an outer surface, an arcuate inside surface, said first member having a right section and a left section;

(b) a second member having an inner surface, an arcuate outside surface;

(c) said arcuate inside surface positioned on top of said arcuate outside surface and configured to be rotated relative to each other;

(d) means for adjusting a distance between said right and left sections; and (e) means for locking said surfaces in one of a plurality of positions, whereby said rest may have a plurality of heights, said locking means comprises a plurality of spaced, longitudinal openings formed in one of said inside and outside surfaces, and a longitudinal protrusion operatively connected to the other of said inside and outside surfaces, said protrusion slideable in a longitudinal direction but lock said members from further relative rotational movement.

* * * * *

UNITED STATES PATENT AND TRADEMARK OFFICE

CERTIFICATE OF CORRECTION

PATENT NO. : 5,088,668

DATED : February 18, 1992

INVENTOR(S) : Thomas M. Grimm

It is certified that error appears in the above-identified patent and that said Letters Patent is hereby corrected as shown below:

In column 1, line 18, please delete "is" and substitute therefore --in--.

In column 4, line 34, please delete "H" and substitute therefore --$H_1$--.

In column 7, line 1, please delete "2" and substitute therefore --4--.

In column 7, lines 2 and 3, please delete "sections" and substitute therefore --section--.

Signed and Sealed this

Eighth Day of June, 1993

*Attest:*

Michael K. Kirk

MICHAEL K. KIRK

*Attesting Officer*

*Acting Commissioner of Patents and Trademarks*